US005216871A

United States Patent [19]

Hannen

[11] Patent Number: 5,216,871

[45] Date of Patent: Jun. 8, 1993

[54] SYSTEM FOR WRAPPING PALLETIZED GOODS

[75] Inventor: Reiner W. Hannen, Pfalzdorf, Fed. Rep. of Germany

[73] Assignee: Develog, Reiner Hannen & Cie, Cortebert, Switzerland

[21] Appl. No.: 872,757

[22] Filed: Apr. 23, 1992

[30] Foreign Application Priority Data

Apr. 24, 1991 [DE] Fed. Rep. of Germany ..... 4113281

[51] Int. Cl.[5] ..... B65B 13/04

[52] U.S. Cl. ..... 53/556; 53/399; 53/441; 53/588

[58] Field of Search ..... 53/399, 441, 556, 587, 53/588, 449

[56] References Cited

U.S. PATENT DOCUMENTS

| | | | |
|---|---|---|---|
| 4,204,377 | 5/1980 | Lancaster | 53/556 X |
| 4,409,776 | 10/1983 | Usui | 53/399 |
| 4,905,448 | 3/1990 | Plitt | 53/399 |
| 4,905,451 | 3/1990 | Jaconelli | 53/587 X |
| 4,912,911 | 4/1990 | Down | 53/587 X |
| 5,085,030 | 2/0992 | Segawa | 53/399 |

FOREIGN PATENT DOCUMENTS

| | | | |
|---|---|---|---|
| 32140 | 7/1981 | European Pat. Off. | 53/588 |
| 0278617 | 8/1988 | European Pat. Off. . | |
| 0467729 | 1/1992 | European Pat. Off. . | |
| 3615450 | 11/1987 | Fed. Rep. of Germany | 53/556 |
| 9012589.4 | 1/1991 | Fed. Rep. of Germany . | |
| 2470055 | 6/1981 | France | 53/399 |
| 2600973 | 1/1988 | France | 53/556 |
| 2098569 | 11/1982 | United Kingdom . | |

OTHER PUBLICATIONS

"The Digest" by Infapak-Sep. 1977.

*Primary Examiner*—John Sipos

*Attorney, Agent, or Firm*—Herbert Dubno; Andrew Wilford

[57] ABSTRACT

A generally parallepipedal package comprised of a stack of goods sitting on a pallet has four horizontally directed sides, vertically oppositely directed top and bottom faces, and upper and lower horizontally extending edges meeting at upper and lower corners. It is wrapped by first securing an end of a stretch foil to the package adjacent the bottom face, then drawing the foil from one of lower corners of one of the sides diagonally across the one side to the diagonally opposite upper corner of the one side while maintaining the foil taut, and then laying the foil on and along the upper edge of the adjacent side extending perpendicularly from the one side to the opposite upper corner with the foil contacting both the top face and the one side. Subsequently the foil is drawn from the opposite upper corner of the other side diagonally downward across the side opposite to the one side to the diagonally opposite lower corner of the opposite side and then is laid on and along the lower edge of the adjacent side extending perpendicularly from the one side to the opposite lower corner.

5 Claims, 4 Drawing Sheets

SYSTEM FOR WRAPPING PALLETIZED GOODS

FIELD OF THE INVENTION

The present invention relates to the wrapping of palletized goods. More particularly this invention concerns a method of and apparatus for packaging palletized goods.

BACKGROUND OF THE INVENTION

Copending patent application Ser. No. 743,046 filed Aug. 9, 1991 with reference to copending application Ser. No. 712,156 filed Jun. 6, 1991 (now U.S. Pat. No. 5,163,264) describes a method of packaging a stack of articles on a pallet forming a palletized unit comprising a top formed by the stack, vertical sides formed by the stack, and a bottom adapted to support the unit. The pallet has skids along its bottom extending parallel to a first pair of the sides and accessible to a fork for lifting and moving the unit at a second pair of the sides. Such a package is wrapped by first wrapping it substantially horizontally by winding a foil band in a plurality of generally horizontal turns around the sides and then wrapping it substantially vertically by winding a foil band around the unit in a plurality of generally vertical turns from the top to the bottom and along one of the pairs of the sides.

This method, in which the palletized unit is wrapped substantially horizontally around all of its vertical sides and is wrapped substantially vertically over the head and foot or top and bottom of the unit and over at least one pair of opposite vertical sides has been found to provide surprising advantages over the conventional methods described. On the one hand, it ensures a reliable connection between the pallet and the stack of articles and goods while, on the other hand, it ensures that lateral or horizontal slip of individual layers of the articles will be avoided.

While this system offers substantial advantages over known prior-art arrangements, the package is still capable of deforming. In particular if dropped on a corner, the entire stack can shift laterally and require rewrapping. Furthermore the known procedures use the stretch foil lavishly, increasing packaging costs

OBJECTS OF THE INVENTION

It is therefore an object of the present invention to provide an improved system for wrapping a stack of palletized goods.

Another object is the provision of such an improved system for wrapping a stack of palletized goods which overcomes the above-given disadvantages, that is which solidly holds the stack on the pallet and effectively resists lateral stresses.

A further object is to provide a stretch-wrapping system (not a shrink-wrapping one) that uses the stretch foil economically.

SUMMARY OF THE INVENTION

According to this invention a generally parallepipedal package comprised of a stack of goods sitting on a pallet has four horizontally directed sides, vertically oppositely directed top and bottom faces, and upper and lower horizontally extending edges meeting at upper and lower corners. It is wrapped by first securing an end of a stretch foil to the package adjacent the bottom face, then drawing the foil from one of lower corners of one of the sides diagonally across the one side to the diagonally opposite upper corner of the one side while maintaining the foil taut, and then laying the foil on and along the upper edge of the adjacent side extending perpendicularly from the one side to the opposite upper corner with the foil contacting both the top face and the one side. Subsequently the foil is drawn from the opposite upper corner of the other side diagonally downward across the side opposite to the one side to the diagonally opposite lower corner of the opposite side and then is laid on and along the lower edge of the adjacent side extending perpendicularly from the one side to the opposite lower corner.

With this system, therefore, the foil strip runs diagonally to resist both horizontal and vertical stresses applied to the package. The process is repeated to form a diagonal foil-strip cross on each side of the package. Not only does such a method very solidly wrap the package, but it does so with a very small amount of the foil which is only lapped at the corners and at the middle of each side.

According to another feature of the invention the package is held stationary during the drawing and laying steps and the foil is pulled off a supply that is moved around the package to lay it on the sides and draw it across the edges. Alternately the package is moved vertically during the laying steps and a supply of the foil is moved horizontally during the laying and drawing steps. It is even possible when the foil is laid along edges for it to be laid against the respective sides and faces of the package.

When the pallet has skid feet spaced inwardly of two of the lower edges and a skid plate projecting past the feet at the two lower edges, the foil is laid against the plate and against the respective sides when it is laid along the lower edges. On the other hand when the pallet has skid feet extending at and along two of the lower edges and a skid plate from which the skid feet project downward, the foil is laid on the plate inward of the respective skid feet when it is laid along a lower edge.

The apparatus according to this invention comprises a support carrying the package with the sides and edges exposed, a ring positionable around the package, a satellite displaceable on the ring about the package, a supply of the foil carried on the satellite, and a drive for relatively vertically displacing the package and ring while orbiting the satellite o the ring about the package to wrap the foil in an "X" on each side of the parallepipedal package in the manner described above.

The supply according to the invention includes a roll of the film centered on a roll axis and a holder carrying the roll and pivotal on the satellite about an axis perpendicular to and crossing the roll axis. The drive includes means for pivoting the ring between an angled position used during drawing of the foil diagonally over the package sides and a horizontal position used during laying of the foil along the package edges. The support has arms between which the ring is pivotal.

The drive means of the invention can be connected to the support for vertically displacing the package in the ring while the satellite is orbited about the ring. Alternately it can be connected to the support for horizontally displacing the package in the ring while the satellite is orbited about the ring.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
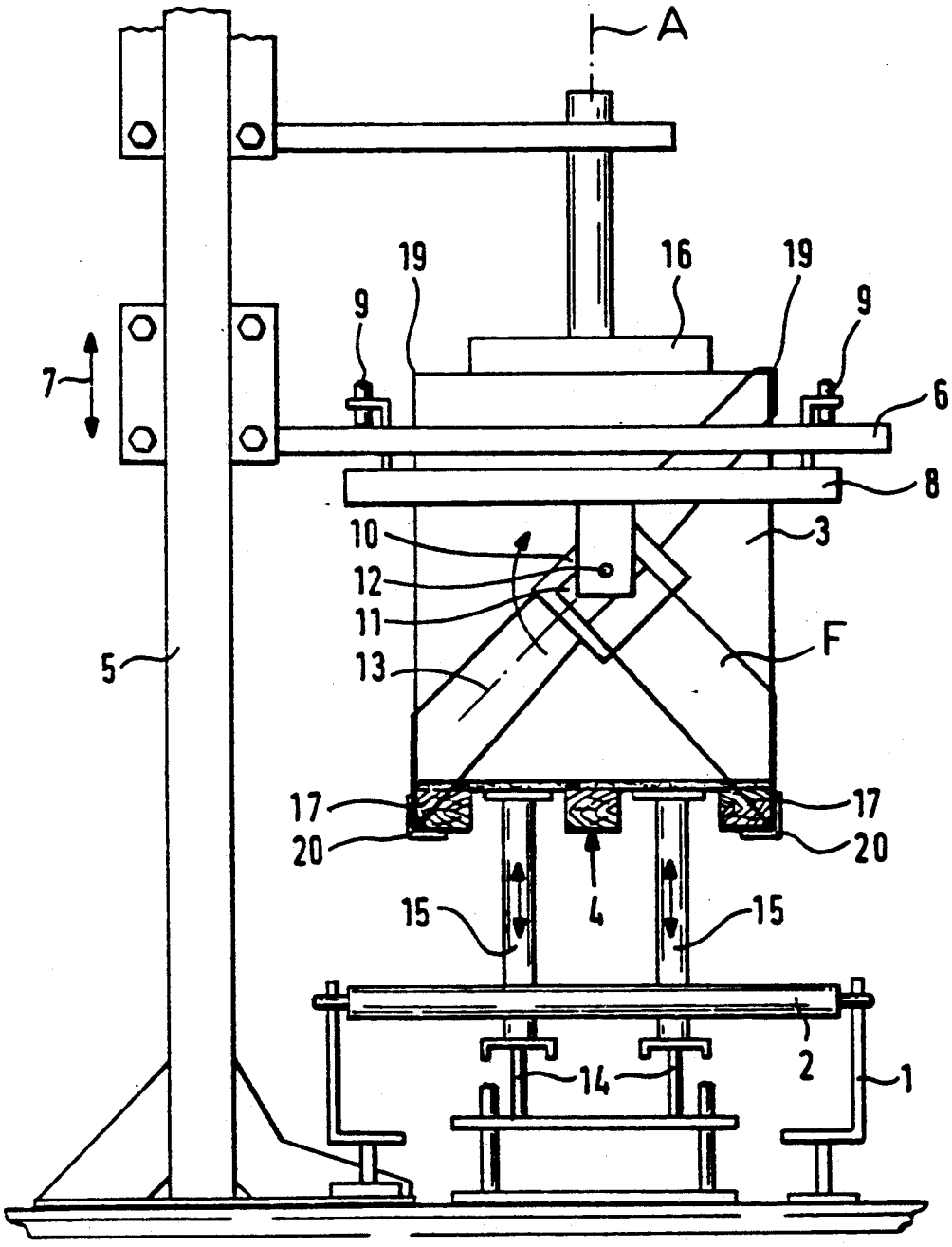
FIG. 1 is a partly diagrammatic side view illustrating the apparatus for carrying out the method of this invention.
Figure 4:
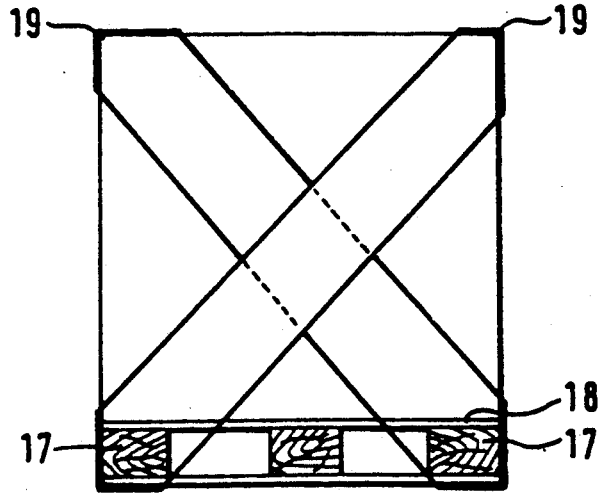
FIG. 4 is a view like FIGS. 2 and 3 showing the system of FIG. 1.

As seen in FIGS. 1 and 4 a conveyor 1 comprised of rollers 2 carries a pallet 4 on which stands a stack 3 of boxes. The conveyor 1 normally moves the package 3, 4 in a direction perpendicular to the plane of the view of FIG. 1.

A support 5 adjacent the conveyor 1 carries an annular frame 6 that is vertically displaceable as indicated by arrow 7 and that in turn carries a ring 8 that can rotate on the frame 6 about a vertical axis A that here passes centrally through the package 3, 4. A braked holder 10 carries a roll 11 of a stretch (not a shrink) film F that is wound about an axis 13 and that also can pivot on the ring 8 about an axis 12 that perpendicularly traverses the axis 13 and that also normally is radial of the axis A. Drive wheels 9 can be rotated to orbit the supply 11 about the package 3, 4.

A lift device 14 has posts 15 that can project upward between the rollers 2 to raise the package 3, 4 off the conveyor 1 and press it upward against a vertically displaceable holddown plate 6 that is carried on the support 5. This lifting of the package 3, 4 leaves its lower edges exposed.

According to the invention as seen in FIGS. 1 and 4 the package 3, 4 is wrapped by being first lifted to clamp it between the holddown plate 16 and the lifters 15. This positions the ring 8 around the package. Then the free end of the film F is attached to the package 3, 4, for instance by stapling it to the pallet 4, and the film F is pulled from the lower corner of one side diagonally across that side to the opposite upper corner. This is done by simultaneously rotating the ring 8 on the frame 6 while raising the frame 6.

Then the frame 6 is held stationary while the ring 8 orbits the supply 11 through another quadrant, laying the film on an upper edge 19 of the package 3, 4.

The frame 6 is then lowered as the ring 8 orbits through a third quadrant to lay the film F diagonally across the opposite side of the package 3, 4.

These steps can be repeated again two more times, typically by just laying the foil along the next lower edge and repeating the cycle, and then can be done in the opposite direction to produce a criss-cross wrap as shown in FIG. 4. The strip of foil where it runs across the upper edges 19 contacts both the top face and the respective side of the package 3, 4. Where it runs along a bottom edge it contacts a skid foot 17 secured to the plate or panel 18 of the pallet 3 as well as the respective side.

According to the invention an L-section protector 20 is then applied over the foil F on the lower edge of the package to protect the foil F. This is important to prevent friction occurring during shipping from severing the foil strip.

Figure 2:
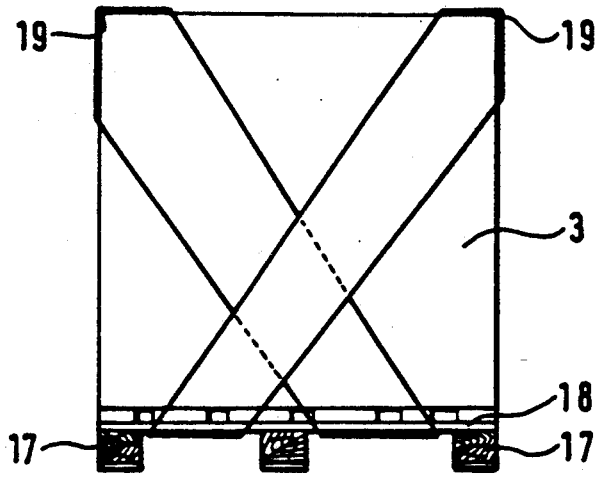
FIGS. 2 and 3 are small-scale views illustrating packaging methods according to the invention.

In FIG. 2 the lower stretch of the foil F extends somewhat inward of the lower package edge, inward of the skids 17 which are placed just at the package edges.

Figure 3:
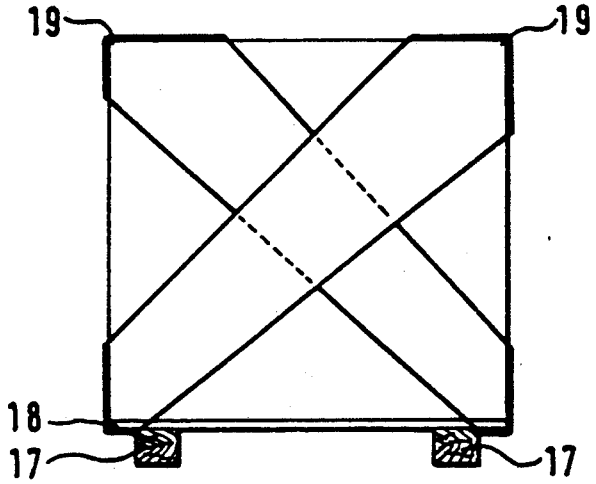

FIG. 3 shows how when the skid 17 is set inward of the outer edge of the pallet plate 18 the foil F is wrapped under the plate 18 outboard of the skid 17.

Figure 5:
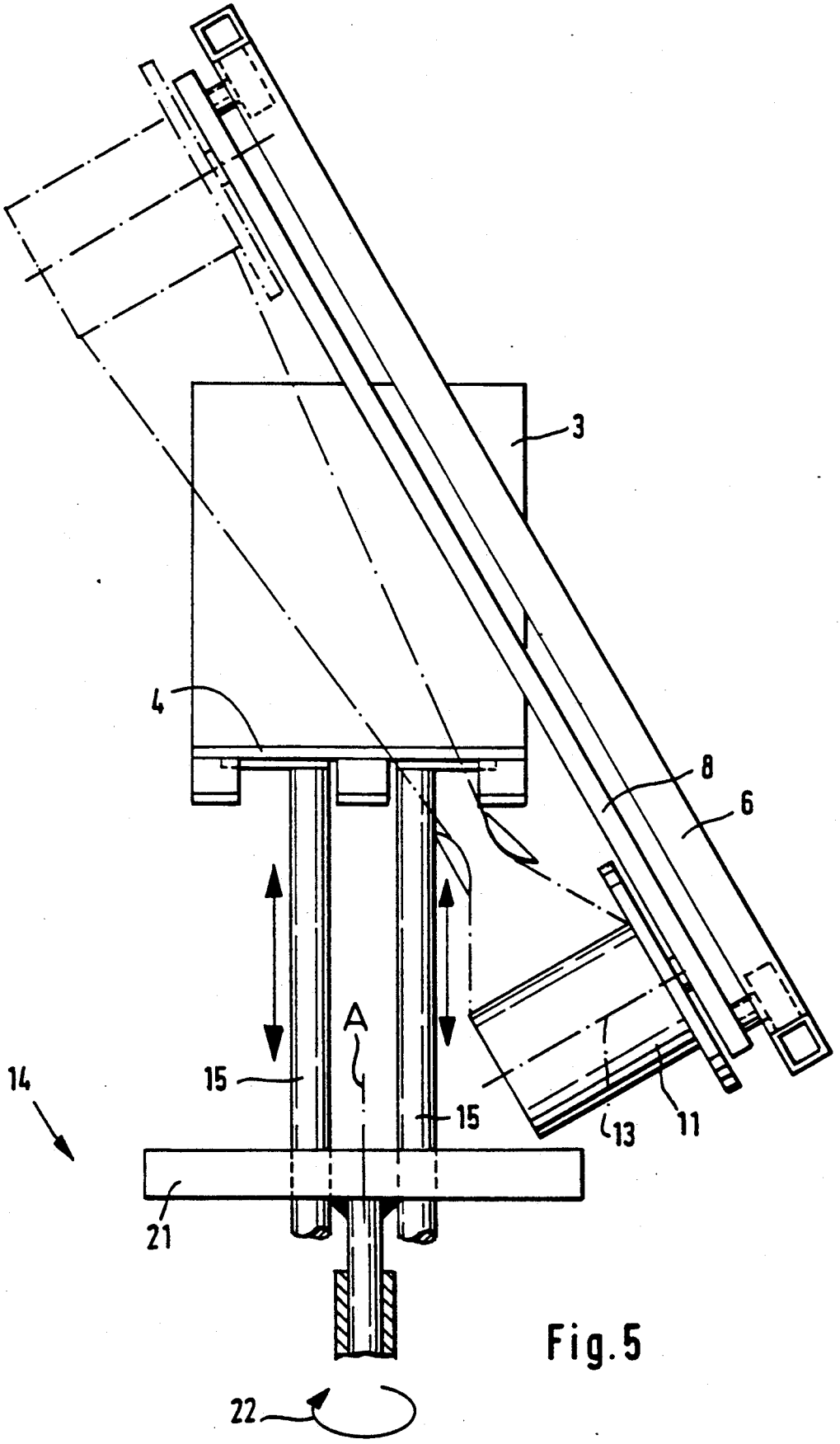
FIGS. 5 and 6 are diagrammatic side views of further apparatuses according to the invention.

The system of FIG. 5 has a support frame 6 and ring 8 that are mounted at a permanent 60 angle to the horizontal. This frame 6 is not vertically displaceable. To wrap the foil F in the desired diagonal pattern the lifters 15 for the package 3, 4 are mounted on a turntable 21 that can be rotated as indicated by arrow 22 about the axis A.

Figure 6:
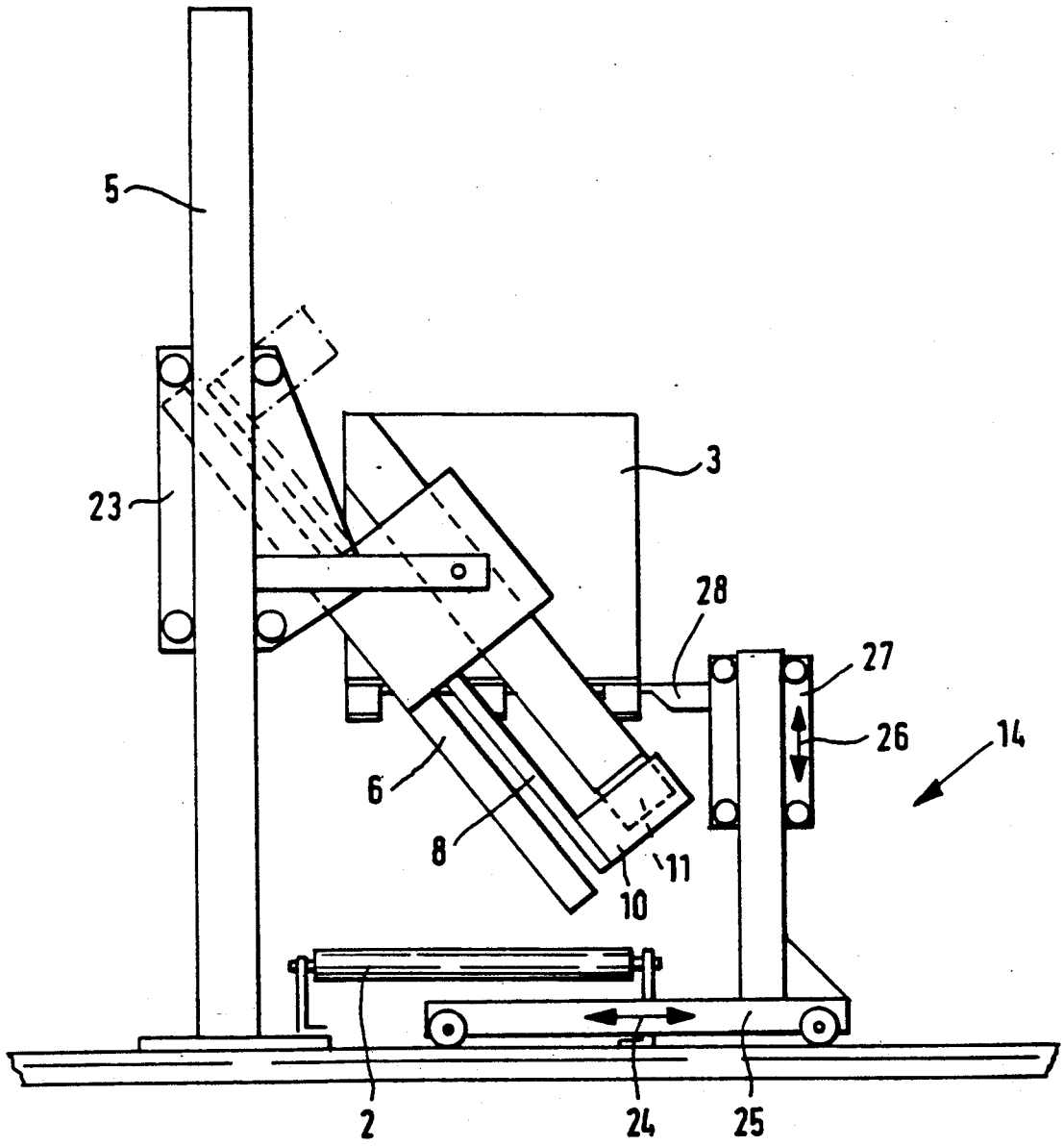

In the arrangement of FIG. 6 the support 5 is also angled, but the lifter 14 comprises a carriage 25 displaceable horizontally as indicated at arrow 24 and having a holder 27 provided with arms 28 like a fork lift and vertically movable as indicated at arrow 26. Thus the package 3, 4 can be moved horizontally as the supply 11 orbits, with or without vertical displacement of the frame 6.

I claim:

1. An apparatus for wrapping a stretch foil around a generally parallepipedal package comprised of a stack of goods sitting on a pallet, the package having four horizontally directed sides, vertically oppositely directed top and bottom faces, and upper and lower horizontally extending edges meeting at upper and lower corners, the apparatus comprising:

a support carrying the package with the sides and edges exposed;

a ring positionable around the package;

a satellite displaceable on the ring about the package;

a supply of the foil carried on the satellite;

drive means for relatively vertically displacing the package and ring while orbiting the satellite on the ring about the package to sequentially draw the foil form one of lower corners of one of the sides diagonally across the one side to the diagonally opposite upper corner of the one side while maintaining the foil taut;

lay the foil on and along the upper edge of the adjacent side extending perpendicularly from the one side to the opposite upper corner with the foil contacting both the top face and the one side;

draw the foil from the opposite upper corner of the other side diagonally downward across the side opposite to the one side to the diagonally opposite lower corner of the opposite side; and lay the foil on and along the lower edge of the adjacent side extending perpendicularly from the one side to the opposite lower corner; and means for pivoting the ring between an angled position used during drawing of the foil diagonally over the package sides and a horizontal position used during laying of the foil along the package edges.

2. The package-wrapping apparatus defined in claim 1 wherein the supply includes a roll of the film centered on a roll axis and a holder carrying the roll and pivotal on the satellite about an axis perpendicular to and crossing the roll axis.

3. The package-wrapping apparatus defined in claim 1 wherein the support has arms between which the ring is pivotal.

4. The package-wrapping apparatus defined in claim 1 wherein the drive means is connected to the support for vertically displacing the package in the ring while the satellite is orbited about the ring.

5. The package-wrapping apparatus defined in claim 1 wherein the drive means is connected to the support for horizontally displacing the package in the ring while the satellite is orbited about the ring.

* * * * *